US008198964B2

(12) United States Patent
Yoshihara et al.

(10) Patent No.: US 8,198,964 B2
(45) Date of Patent: Jun. 12, 2012

(54) SEALED CONTACT DEVICE

(75) Inventors: Ikuhiro Yoshihara, Yamaga (JP); Keisuke Yano, Kikuchi (JP); Ryuichi Hashimoto, Yamaga (JP)

(73) Assignee: OMRON Corporation, Kyoto (JP)

( * ) Notice: Subject to any disclaimer, the term of this patent is extended or adjusted under 35 U.S.C. 154(b) by 6 days.

(21) Appl. No.: 13/016,539

(22) Filed: Jan. 28, 2011

(65) Prior Publication Data

US 2011/0221548 A1 Sep. 15, 2011

(30) Foreign Application Priority Data

Mar. 9, 2010 (JP) ..... 2010-052043

(51) Int. Cl.
*H01H 67/02* (2006.01)
*H01H 9/30* (2006.01)

(52) U.S. Cl. ..... 335/131; 335/201

(58) Field of Classification Search ..... 335/131, 335/201, 132

See application file for complete search history.

(56) References Cited

U.S. PATENT DOCUMENTS

| | | | | |
|---|---|---|---|---|
| 5,892,194 | A | 4/1999 | Uotome et al. | |
| 5,973,581 | A * | 10/1999 | Jacquin et al. | 335/131 |
| 6,911,884 | B2 * | 6/2005 | Uotome et al. | 335/132 |
| 7,859,373 | B2 * | 12/2010 | Yamamoto et al. | 335/126 |
| 7,876,183 | B2 * | 1/2011 | Uruma et al. | 335/126 |
| 2009/0284335 | A1 * | 11/2009 | Kim et al. | 335/201 |

FOREIGN PATENT DOCUMENTS

| | | |
|---|---|---|
| EP | 0798752 A2 | 10/1997 |
| JP | 3107288 B2 | 9/2000 |

OTHER PUBLICATIONS

European Search Report for European Application 10196547.3-2214 Dated Jun. 28, 2011 (4 pages).

* cited by examiner

*Primary Examiner* — Lincoln Donovan
*Assistant Examiner* — Alexander Talpalatskiy
(74) *Attorney, Agent, or Firm* — Osha • Liang LLP

(57) ABSTRACT

A sealed contact device has a plate-like yoke having a center hole therein, a closed-ended cylinder having an opening edge portion that is integrated with a lower-surface edge portion of the center hole of the plate-like yoke to form a sealed space, an annular flange having an outer peripheral edge portion that is integrally welded to an upper surface of the plate-like yoke, a ceramic case having a lower end surface that is brazed to an upper surface of the annular flange, an electromagnetic unit disposed in an outer periphery of the closed-ended cylinder, a movable iron core that reciprocates in the closed-ended cylinder based on excitation and demagnetization of the electromagnetic unit, a movable shaft having a first end fixed to the movable iron core, a movable contact of a movable touch piece fixed to a second end of the movable shaft, a fixed contact disposed in the ceramic case, and an annular rib projected in the upper surface of the annular flange such that the brazed portion provided in the lower end surface of the ceramic case is covered from an inside with the annular rib. The movable contact is brought into contact with and separated from the fixed contact by reciprocating the movable shaft.

8 Claims, 8 Drawing Sheets

SEALED CONTACT DEVICE

BACKGROUND OF THE INVENTION

1. Technical Field

The present invention relates to a sealed contact device, particularly to a sealed contact device suitable to a power-load relay or an electromagnetic switch.

2. Related Art

For example, Japanese Patent No. 3107288 discloses a sealed contact device in which a fixed contact 2*a* is brought into contact with and separated from a movable contact 3*a* in a sealed space formed by brazing an opening edge portion 1*b* of a sealed container 1 made of an insulating material to a second coupling member 12.

However, as illustrated in FIG. 1 and FIG. 9 of the sealed contact device disclosed in Japanese Patent No. 3107288, the brazed portion is exposed in the sealed space. Therefore, as illustrated in FIG. 9, when arc is generated between the fixed contact 2*a* and the movable contact 3*a*, the brazed portion is melted by heat of the arc to degrade sealing performance.

SUMMARY

One or more embodiments of the invention includes a sealed contact device, wherein an opening edge portion of a closed-ended cylinder is integrated with lower-surface edge portion of a center hole made in a plate-like yoke to form a sealed space while a lower end surface of a ceramic case is brazed to an upper surface of an annular flange whose outer peripheral edge portion is integrally welded to an upper surface of the plate-like yoke, a movable contact of a movable touch piece fixed to one end portion of a movable shaft is brought into contact with and separated from a fixed contact disposed in the ceramic case by reciprocating the movable shaft whose the other end is fixed to a movable iron core reciprocating in the closed-ended cylinder based on excitation and demagnetization of an electromagnetic unit disposed in an outer periphery of the closed-ended cylinder, and an annular rib is projected in the upper surface of the annular flange such that the brazed portion provided in the lower end surface of the ceramic case is covered from an inside with the annular rib.

According to one or more embodiments of the invention, the brazed portion provided between the ceramic case and the annular flange is covered from the inside with the annular rib provided in the annular flange. Therefore, even if the arc is generated in separating the movable contact from the fixed contact, because the heat of the arc does not reach the brazed portion, advantageously the sealing performance is not degraded.

When the ceramic case is assembled in the annular flange, the ceramic case is aligned by utilizing the annular rib, so that workability can be improved to enhance assembly accuracy.

In one or more embodiments of the invention, an annular projection is provided in the upper surface of the annular flange, the annular projection being able to be brazed while abutting on the lower end surface of the ceramic case.

Accordingly, the melted brazing material flows in a gap generated between the annular flange and the ceramic case, and the brazing material is solidified in the gap. Therefore, brazing work is facilitated to obtain the sealed contact device having high sealing performance, high strength, and high reliability.

In one or more embodiments of the invention, an annular groove is provided such that the lower end portion of the ceramic case can be fitted on the upper surface of the annular flange.

Accordingly, the alignment work between the annular flange and the ceramic case is precisely and easily performed, and the support strength is increased while the assembly accuracy and workability are improved.

In one or more embodiments of the invention, a cylindrical insulating member is disposed between a cylindrical fixed iron core and the movable shaft, the cylindrical fixed iron core being disposed in the closed-end cylinder and fixed to a lower surface of the plate-like yoke, the movable shaft being inserted in the cylindrical fixed iron core while being reciprocable.

According to one or more embodiments of the invention, even if the arc is generated to become a high voltage in a path of the annular flange, plate-like yoke, and fixed iron core, because the cylindrical fixed iron core and the movable shaft are insulated by the cylindrical insulating member, advantageously the cylindrical fixed iron core and the movable shaft can be prevented from being integrally welded.

DETAILED DESCRIPTION

Figure 1:
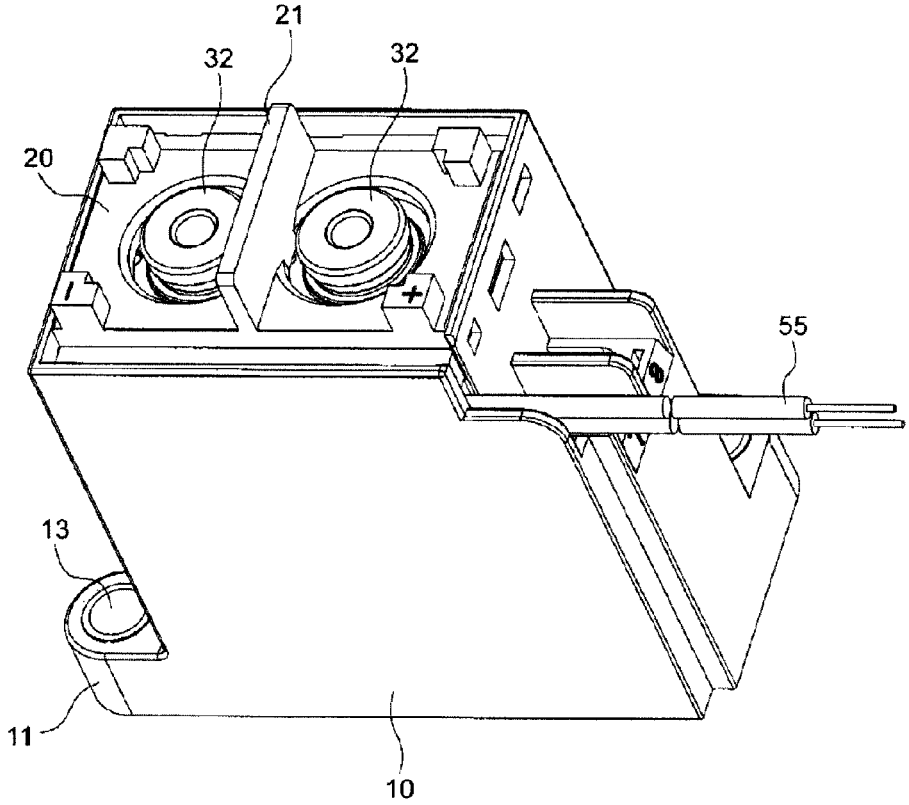
FIG. 1 is a perspective view illustrating a sealed contact device according to one or more embodiments of the invention.
Figure 2:
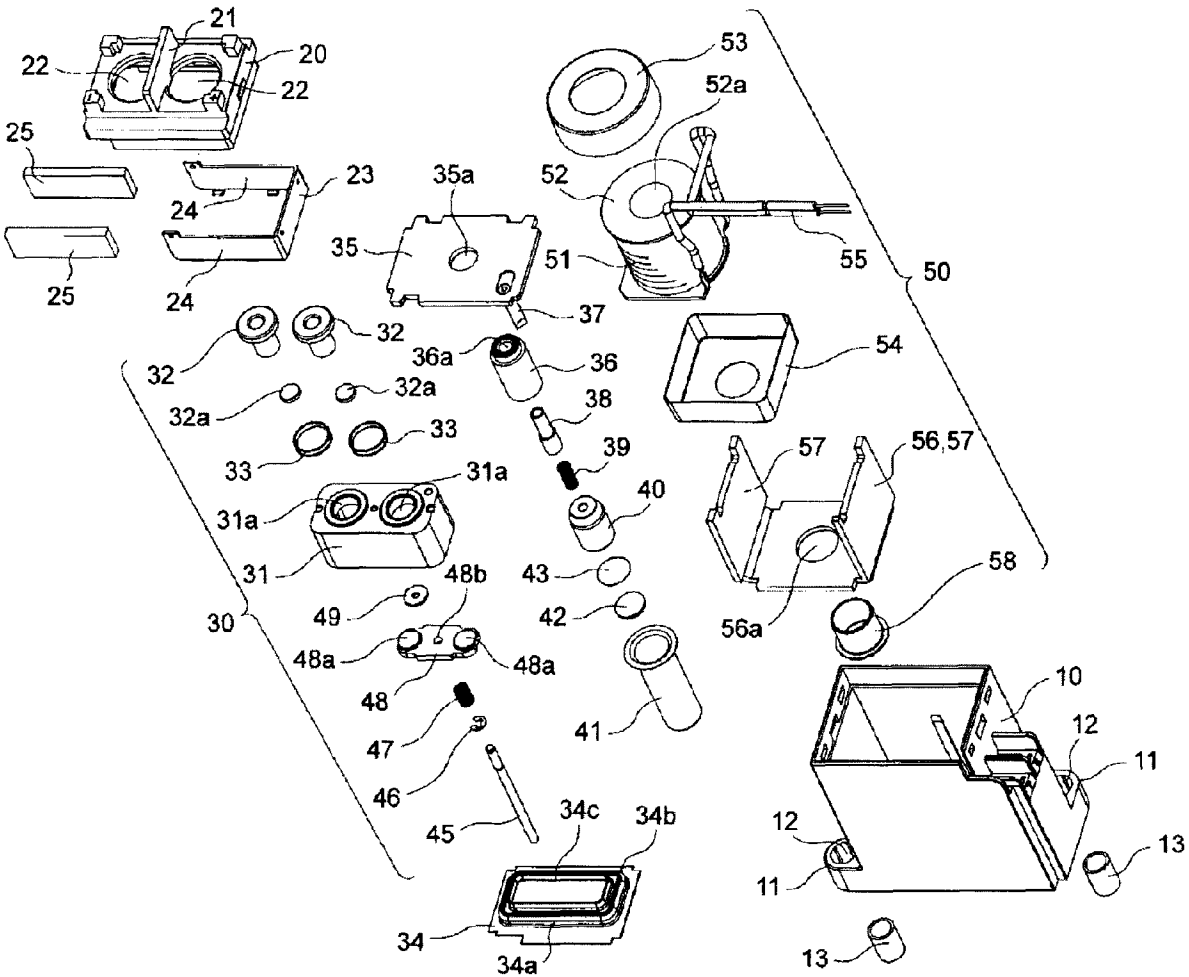
FIG. 2 is an exploded perspective view of the sealed contact device illustrated in FIG. 1.

The case where a sealed contact device according to one or more embodiments of the invention is applied to a sealed electromagnetic relay will be described with reference to FIG. 1 to FIG. 8. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

In the sealed electromagnetic relay according to one or more embodiments of the invention, a contact mechanism unit 30 and an electromagnet unit 50 are accommodated in a housing. The housing is formed by assembling a cover 20 in a case 10. The contact mechanism unit 30 is incorporated in a sealed space including a ceramic case 31, an annular flange 34, a plate-like first yoke 35, and a closed-end cylinder 41. The contact mechanism unit 30 is driven by the electromagnet unit 50.

The case 10 is a resin molding product having a substantially box shape. In the case 10, a reinforcing ring 13 is press-fitted in an attaching hole 12 in an attaching base 11 that is projected outside of a corner portion.

The cover 20 has a planar shape that can be fitted in an opening of the case 10, and terminal holes 22 and 22 are made on both sides of a partition wall 21 that is projected in the center of an upper surface of the cover 20. A holder 23 is fitted in an inside surface of the cover 20. The holder 23 made of a magnetic material has a substantial U-shape when viewed from above. Permanent magnets 25 and 25 are assembled inside the arm portions 24 and 24 of the holder 23.

In the contact mechanism unit 30, a fixed iron core 36, a movable iron core 40, a movable shaft 45, and movable touch piece 48 are incorporated in the sealed space including the ceramic case 31, the annular flange 34, the plate-like first yoke 35, and the closed-end cylinder 41.

Figure 3:
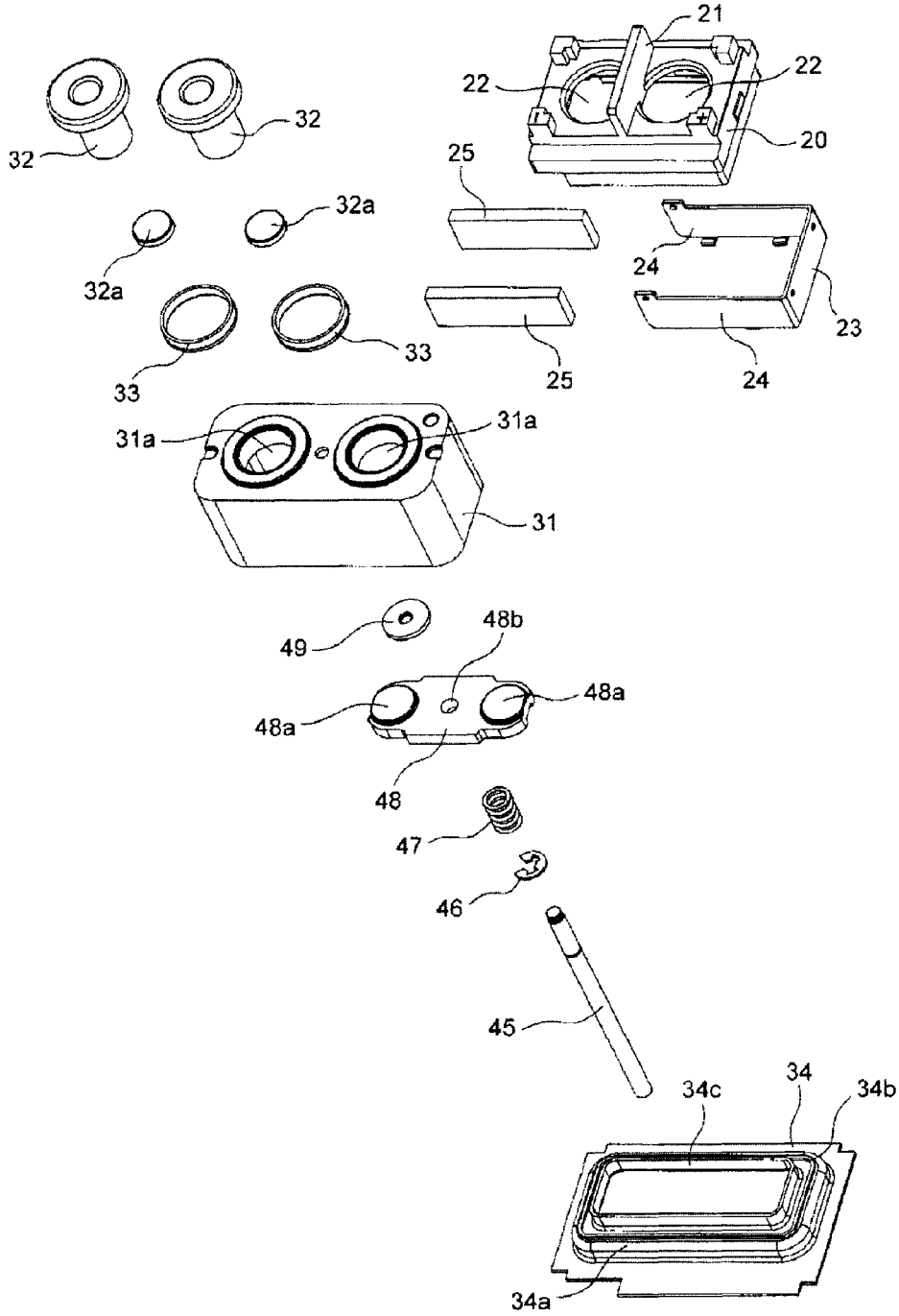
FIG. 3 is a partially enlarged perspective view of the sealed contact device illustrated in FIG. 2.
Figure 6B:
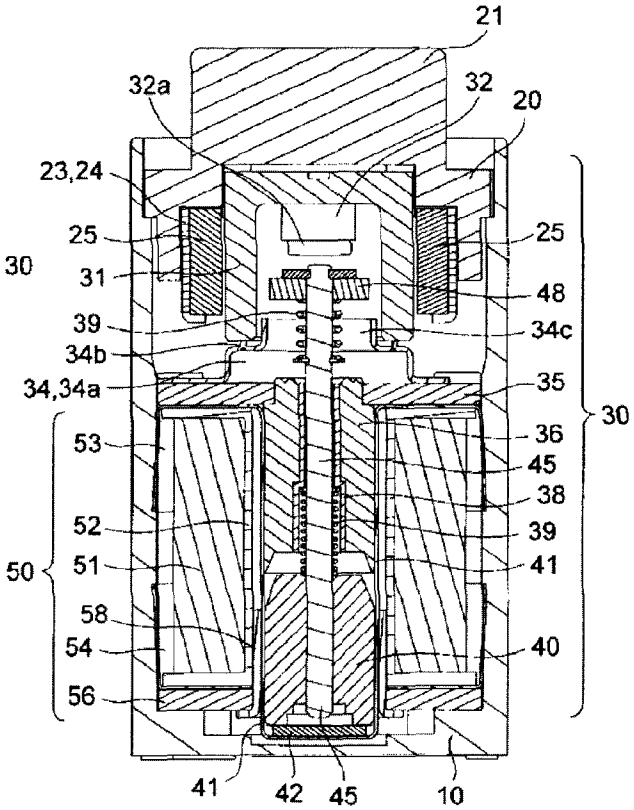
FIG. 6A and FIG. 6B are a front sectional view and a side sectional view illustrating a pre-operation of the sealed contact device illustrated in FIG. 1, respectively.
Figure 6A:
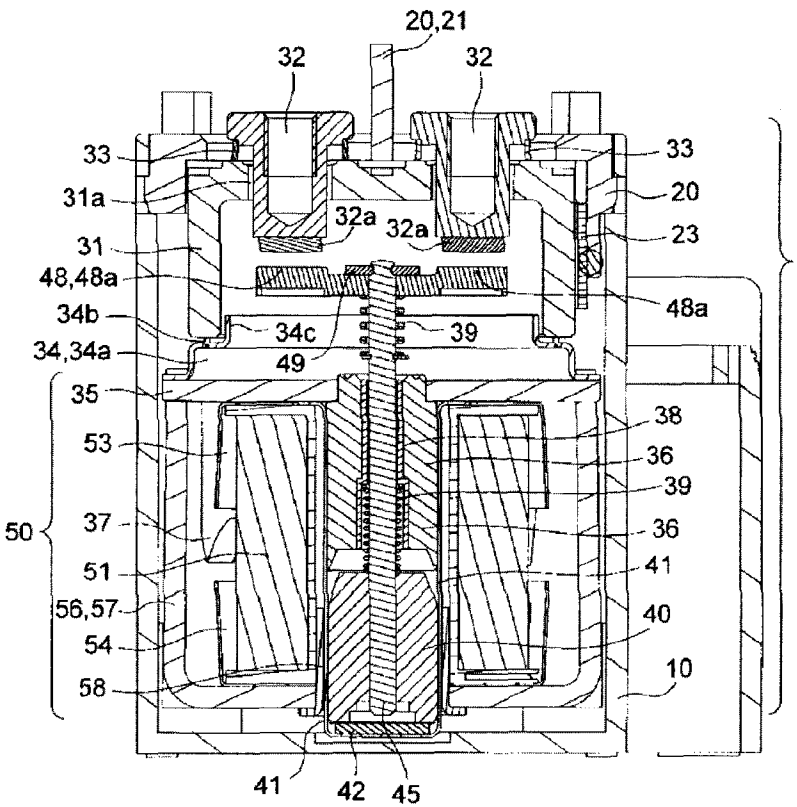
Figure 7B:
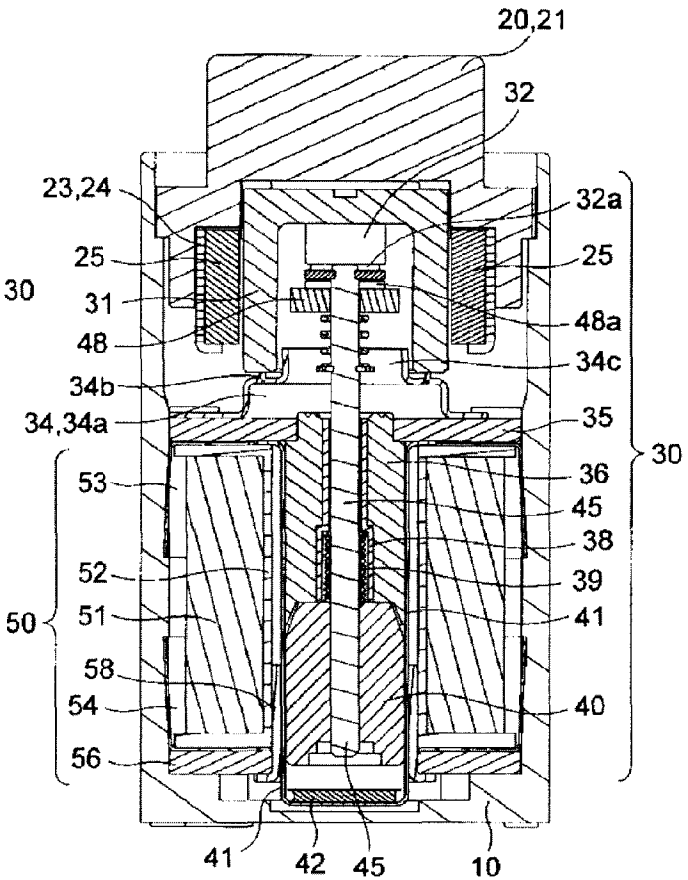
FIG. 7A and FIG. 7B are a front sectional view and a side sectional view illustrating a post-operation of the sealed contact device illustrated in FIG. 1, respectively.
Figure 7A:
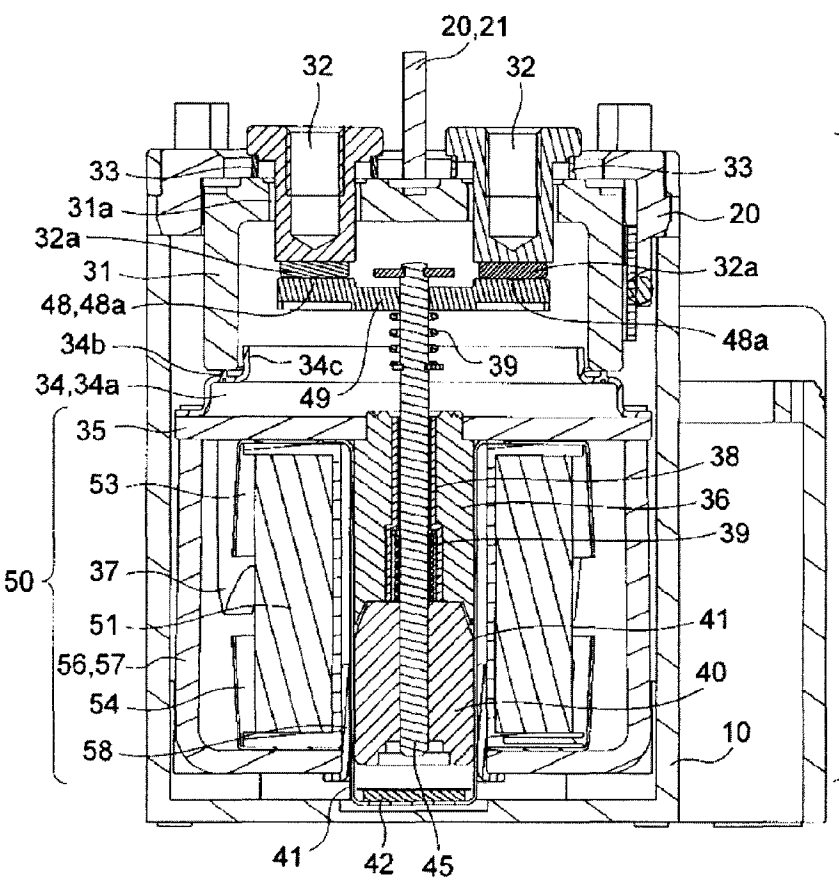

The ceramic case 31 has the planar shape that can be fitted in an opening of the case 10. As illustrated in FIG. 3, metallic layers (not illustrated) are formed in an upper-surface edge portion of a pair of terminal holes 31*a* and 31*a* made in an upper surface of the ceramic case 31 and a lower end surface of the ceramic case 31. As illustrated in FIG. 6 and FIG. 7, a fixed contact terminal 32 in which a fixed contact 32*a* is rigidly fixed to a lower end portion is inserted in the terminal hole 31*a*, and the fixed contact terminal 32 is brazed to the ceramic case 31 with a connection ring 33 interposed therebetween.

As illustrated in FIG. 3, in the annular flange 34 brazed to the lower end surface of the ceramic case 31, a brazing annular projection 34*b* is provided along an annular step portion 34*a* formed by pressing a metallic plate, and a defensive annular rib 34*c* is bent and raised inside the brazed annular projection 34*b*. In the annular flange 34, the lower end surface of the ceramic case 31 is brazed to the brazed annular projection 34*b*, and an outer peripheral edge portion of the annular flange 34 is integrally welded to the upper surface of the plate-like first yoke 35.

Figure 4:
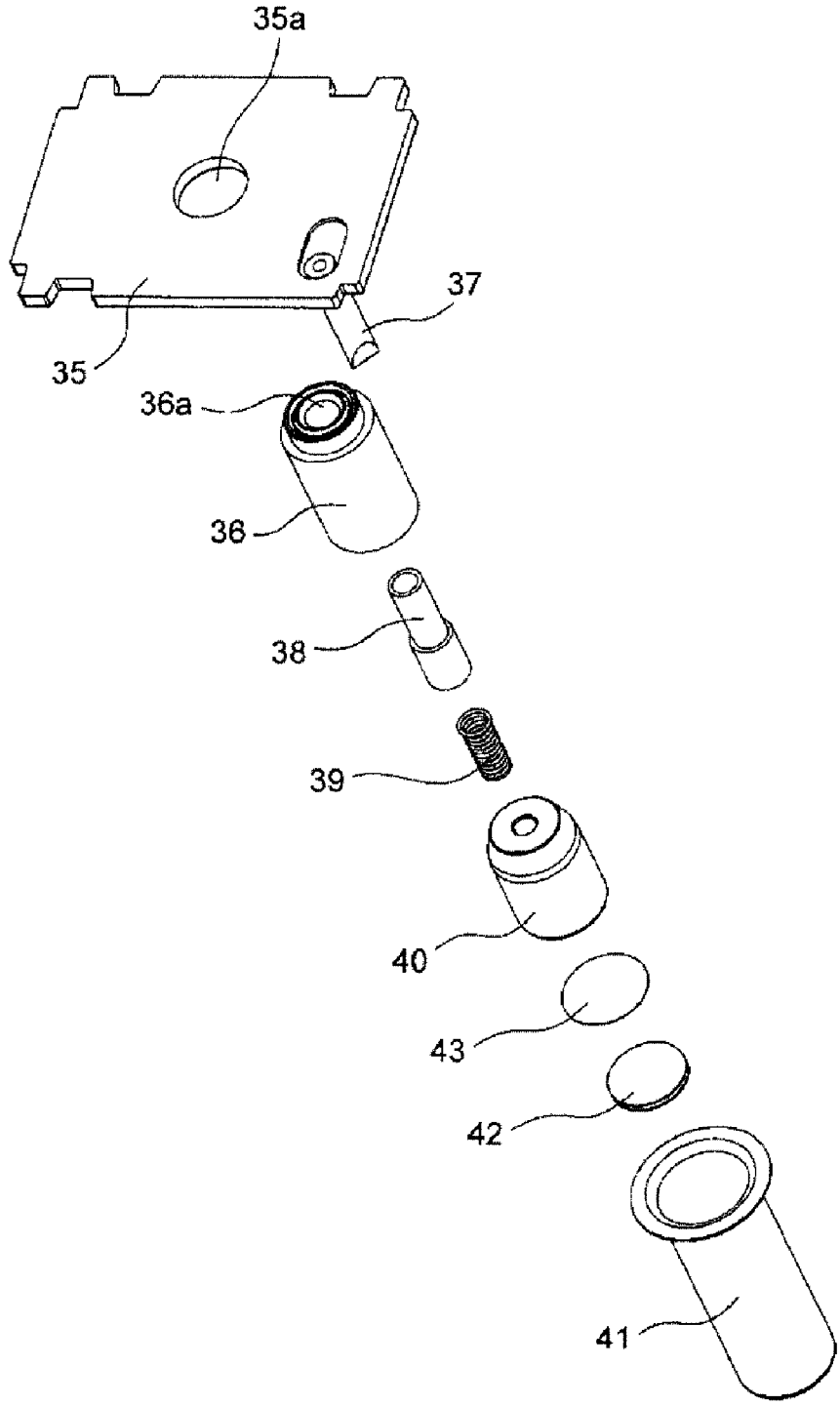
FIG. 4 is a partially enlarged perspective view of the sealed contact device illustrated in FIG. 2.

As illustrated in FIG. 4, the upper end portion of the cylindrical fixed iron core 36 is caulked to a center hole 35*a* of the plate-like first yoke 35, and a degassing pipe 37 is coupled to an end portion of the plate-like first yoke 35 in a sealed manner.

The movable shaft 45 is slidably inserted in the cylindrical fixed iron core 36 while a stepped cylindrical insulating member 38 inserted in a through-hole 36*a* is interposed therebetween. The movable shaft 45 inserted in the stepped cylindrical insulating member 38 is inserted in a return spring 39, and the movable iron core 40 is welded to the lower end portion of the movable shaft 45.

In the closed-end cylinder 41 in which the movable iron core 40 is accommodated, a shock absorber 42 and a stainless-steel thin plate 43 are accommodated in a bottom surface, and an opening edge portion is coupled to a lower-surface edge portion of the center hole 35*a* made in the plate-like first yoke 35 in the sealed manner, thereby forming a sealed space.

As illustrated in FIG. 3, the movable shaft 45 prevents drop-off of the contact spring 47 and movable touch piece 48 by an E ring 46 assembled in an upper portion of the movable shaft 45, and drop-off of the movable shaft 45 is prevented by a retaining ring 49 caulked to the upper end portion of the movable shaft 45. The movable contacts 48*a* provided in both end portions in the upper surface of the movable touch piece 48 are opposite the fixed contact 32*a* disposed in the ceramic case 31 so as to be brought into contact with and separated from the fixed contact 32*a*.

Figure 5:
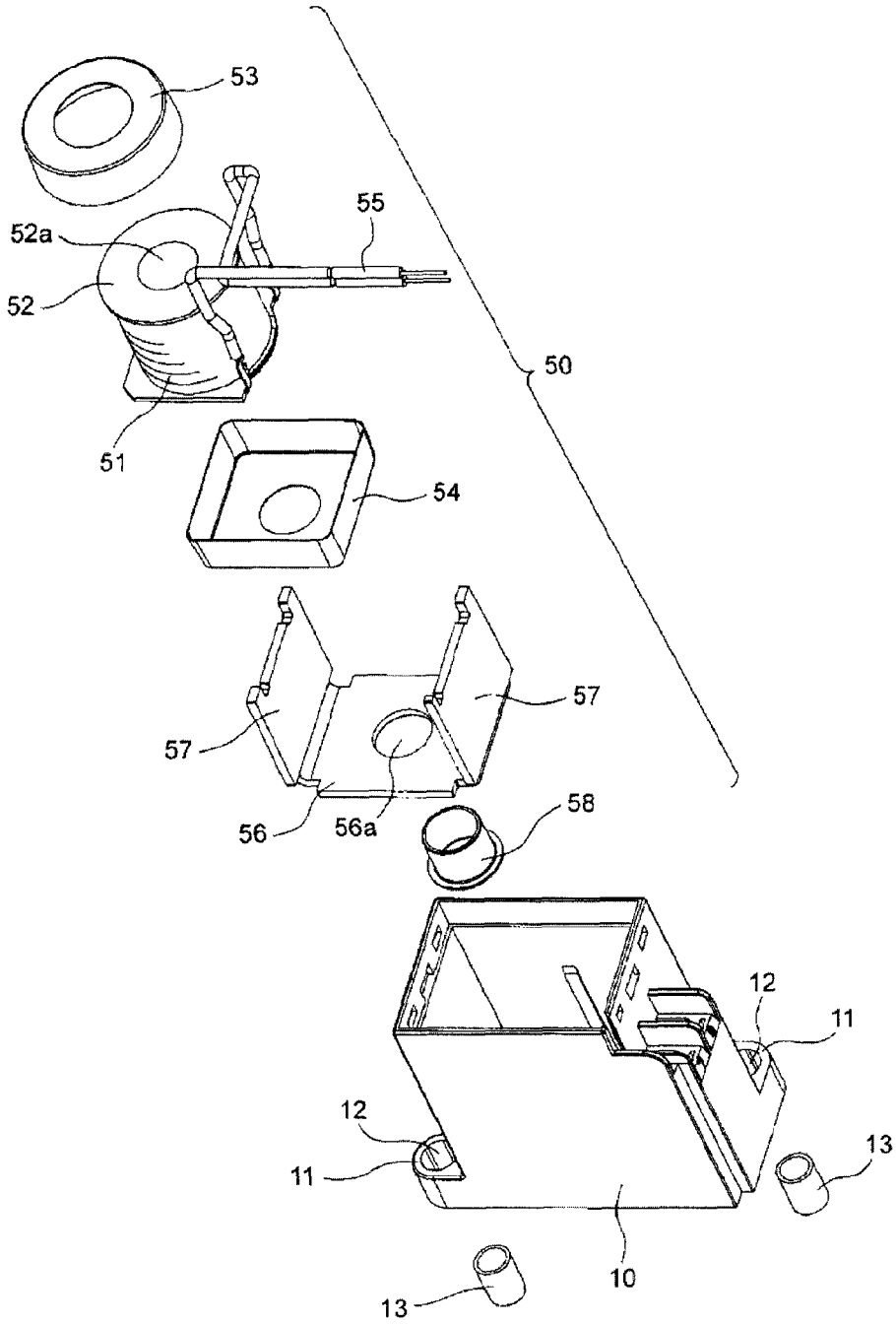
FIG. 5 is a partially enlarged perspective view of the sealed contact device illustrated in FIG. 2.

As illustrated in FIG. 5, in the electromagnet unit 50, upper and lower end portions of a spool 52 around which a coil 51 is wound are covered with resin molding products 53 and 54 that are of insulating material, and the coil 51 is connected to a lead 55. The closed-end cylinder 41 is inserted in a through-hole 52 of the spool 52. Both end portions 57 and 57 of a second yoke 56 in which an auxiliary yoke 58 is assembled in a center hole 56*a* are engaged in and fixed both the end portion of the plate-like first yoke 35, thereby integrating the electromagnet unit 50 with the contact mechanism unit 30.

An operation of the sealed electromagnetic relay having the above-described configuration will be described below.

When a voltage is not applied to the coil 51, the movable iron core 40 is biased downward by a spring force of the return spring 39, thereby pressing down the movable shaft 45. Therefore, the movable touch piece 48 is dragged down, and the movable contact 48*a* is separated from the fixed contact 32*a*.

When the voltage is applied to the coil 51, the movable iron core 40 is attracted by the fixed iron core 36, and the movable shaft 45 slide-moves against the spring force of the return spring 39. Even after the movable contact 48*a* comes into contact with the fixed contact 32*a*, the movable shaft 45 is pushed up against the spring forces of the return spring 39 and contact spring 47, the upper end portion of the movable shaft 45 is projected from the shaft hole 48*b* of the movable touch piece 48, and the movable iron core 40 is stuck to the fixed iron core 36.

When the application of the voltage to the coil 51 is stopped to release magnetic excitation, the movable iron core 40 is separated from the fixed iron core 36 based on the spring forces of the contact spring 47 and return spring 39. Therefore, the movable shaft 45 slide-moves downward, the movable contact 48*a* is separated from the fixed contact 32*a*. Then the movable icon core 40 abuts on the shock absorber 42 with the stainless-steel thin plate 43 interposed therebetween, whereby the movable contact 48*a* returns to the original state.

Figure 8:
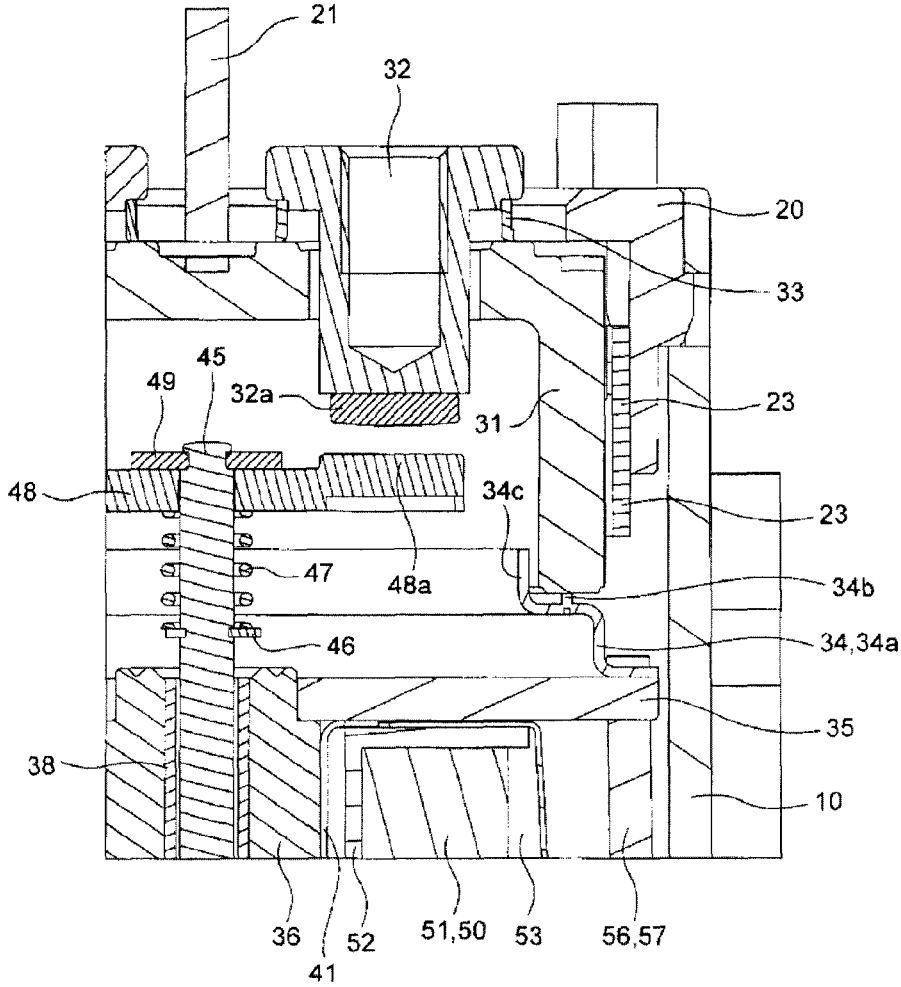
FIG. 8 is a partially enlarged sectional view of FIG. 6A.

According to one or more embodiments of the invention, as illustrated in FIG. 8, the brazed portion provided between the ceramic case 31 and the annular projection 34*b* of the annular flange 34 is covered from the inside with the annular rib 34*c* provided in the annular flange 34. Therefore, even if the arc generated in separating the movable contact 48*a* from the fixed contact 32*a* is attracted outward by the magnetic forces of the permanent magnets 25 and 25, because the heat of the arc does not reach the brazed portion, advantageously the sealing performance is not degraded.

In the sealed contact device according to one or more embodiment of the invention, an annular groove may be formed along an outside base portion of the annular rib 34*c* of the annular flange 34 such that the lower end portion of the ceramic case 31 can be fitted in the groove. The alignment work is facilitated by forming the annular groove, and advantageously the sealing performance is further improved while the assembling work is improved.

Obviously the annular projection may be provided in the bottom surface of the annular groove.

The sealed contact device according to one or more embodiments of the invention is applied to not only the sealed electromagnetic relay but also other electromagnetic switches.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A sealed contact device comprising:

a plate-like yoke having a center hole therein;

a closed-ended cylinder having an opening edge portion that is integrated with a lower-surface edge portion of the center hole of the plate-like yoke to form a sealed space;

an annular flange having an outer peripheral edge portion that is integrally welded to an upper surface of the plate-like yoke;

a ceramic case having a lower end surface that is brazed to an upper surface of the annular flange;

an electromagnetic unit disposed in an outer periphery of the closed-ended cylinder;

a movable iron core that reciprocates in the closed-ended cylinder based on excitation and demagnetization of the electromagnetic unit;

a movable shaft having a first end fixed to the movable iron core;

a movable contact of a movable touch piece fixed to a second end of the movable shaft;

a fixed contact disposed in the ceramic case; and an annular rib projected in the upper surface of the annular flange such that the brazed portion provided in the lower end surface of the ceramic case is covered from an inside with the annular rib, wherein the movable contact is brought into contact with and separated from the fixed contact by reciprocating the movable shaft.

2. The sealed contact device according to claim 1, wherein an annular projection is provided in the upper surface of the annular flange, the annular projection being able to be brazed while abutting on the lower end surface of the ceramic case.

3. The sealed contact device according to claim 1, wherein an annular groove is provided such that the lower end portion of the ceramic case can be fitted on the upper surface of the annular flange.

4. The sealed contact device according to claim 2, wherein an annular groove is provided such that the lower end portion of the ceramic case can be fitted on the upper surface of the annular flange.

5. The sealed contact device according to claim 1, wherein a cylindrical insulating member is disposed between a cylindrical fixed iron core and the movable shaft, the cylindrical fixed iron core being disposed in the closed-end cylinder and fixed to a lower surface of the plate-like yoke, the movable shaft being inserted in the cylindrical fixed iron core while being reciprocable.

6. The sealed contact device according to claim 2, wherein a cylindrical insulating member is disposed between a cylindrical fixed iron core and the movable shaft, the cylindrical fixed iron core being disposed in the closed-end cylinder and fixed to a lower surface of the plate-like yoke, the movable shaft being inserted in the cylindrical fixed iron core while being reciprocable.

7. The sealed contact device according to claim 3, wherein a cylindrical insulating member is disposed between a cylindrical fixed iron core and the movable shaft, the cylindrical fixed iron core being disposed in the closed-end cylinder and fixed to a lower surface of the plate-like yoke, the movable shaft being inserted in the cylindrical fixed iron core while being reciprocable.

8. The sealed contact device according to claim 4, wherein a cylindrical insulating member is disposed between a cylindrical fixed iron core and the movable shaft, the cylindrical fixed iron core being disposed in the closed-end cylinder and fixed to a lower surface of the plate-like yoke, the movable shaft being inserted in the cylindrical fixed iron core while being reciprocable.

* * * * *